United States Patent [19]

Atkinson

[11] Patent Number: 4,622,545

[45] Date of Patent: Nov. 11, 1986

[54] METHOD AND APPARATUS FOR IMAGE COMPRESSION AND MANIPULATION

[75] Inventor: William D. Atkinson, Los Gatos, Calif.

[73] Assignee: Apple Computer, Inc., Cupertino, Calif.

[21] Appl. No.: 428,635

[22] Filed: Sep. 30, 1982

[51] Int. Cl.[4] ..... G09G 1/00

[52] U.S. Cl. ..... 340/747; 340/703; 340/748; 340/734; 358/183; 358/261

[58] Field of Search ..... 340/703, 750, 798, 799, 340/801, 803, 748, 734, 747, 723; 358/183, 22, 261

[56] References Cited

U.S. PATENT DOCUMENTS

| | | | |
|---|---|---|---|
| 3,305,841 | 2/1967 | Schwartz | 340/748 |
| 4,233,601 | 11/1980 | Hankins et al. | 340/703 |
| 4,266,242 | 5/1981 | McCoy | 358/183 |
| 4,334,245 | 6/1982 | Michael | 358/183 |
| 4,360,831 | 11/1982 | Kellar | 358/183 |
| 4,399,467 | 8/1983 | Subramaniam | 358/261 |
| 4,420,770 | 12/1983 | Rahman | 358/183 |

*Primary Examiner*—Marshall M. Curtis

*Attorney, Agent, or Firm*—Blakely Sokoloff Taylor & Zafman

[57] ABSTRACT

Apparatus and methods are disclosed which are most advantageously used in conjunction with a digital computer to provide improved graphics capability. These techniques permit the representation and manipulation of any arbitrarily shaped image in terms of "inversion points". Inversion points defining a region are sorted and stored such that the region shape may be regenerated at a later time from the inversion points. Means are provided to compare existing regions and new regions to be displayed, and region operators are provided to specify a precedence between the existing and new regions. Thus, new regions are appropriately "clipped" such that only portions of a new region may actually be displayed to achieve the desired graphic representation.

35 Claims, 20 Drawing Figures

METHOD AND APPARATUS FOR IMAGE COMPRESSION AND MANIPULATION

BACKGROUND OF THE INVENTION

1. Field

The present invention relates to apparatus and methods for displaying graphic information. More particularly, the present invention relates to data processing apparatus and methods for generating and manipulating images and data on a display system.

2. Prior Art

In the computing industry, it is quite common to represent and convey information to a user through graphic representations. These representations may take a variety of forms, such as for example alphanumeric characters, cartesian or other coordinante graphs, as well as shapes of well known physical objects, etc. Historically, humans have interfaced with computers through a system of discrete commands which typically comprise a combination of both text and mathematical symbolic characters. Examples of such systems are numerous and include the programming languages of Fortran, Algol, PL/1, Basic, and Cobol, which transform a given set of user commands into machine executable "object" code.

However, the ease with which a user becomes proficient in programming or interacting with a computer based system is generally a function of how close the system models the logical thought of the user himself. If the user is able to enter commands in the order in which he would find most logically appropriate, rather than having to transpose his desired command into the code of a programming language, greater user effeciency in using the system is achieved.

One system which has been developed to minimize the learning and acclamation period which a user must go through in order to become proficient in the interaction with a computer system is frequently referred to as an "object-oriented" or "Smalltalk" system. The Smalltalk approach is to replace many common coded programming commands with two-dimensional graphics and animation on a computer display. Quantitatively, it has been found that since people readily think in terms of images, a person can absorb and manipulate information presented in a visual context much faster than if represented by text. The particular type of graphic interface by which the user interacts with the machine may vary for any given application.

One common Smalltalk interface approach utilizes multiple "windows" displayed on a cathode ray tube (CRT) in which combinations of text and graphics are used to convey information. For example, each window may take the form of a file folder, of the type used in a standard filing cabinet, overlapping other folders, with the "top" fully visible folder constituting the current workfile. A user may add or delete information from a file, refile the file folder in another location, and generally operate on the file just as if an actual file in an office was being used. Thus, by graphically presenting an image which represents the object of the user's command, and allowing the user to operate on and manipulate the image in substantially the same way he would as if the image constituted the actual object, the machine becomes easier to operate to the user and a stronger man-machine interface is achieved. See, for example, D. Robson, "Object-Oriented Software Systems", *BYTE*, August 1981, Page 74, Vol. 6, No. 8; and L. Tesler, "The Smalltalk Environment", *BYTE*, August 1981, page 90, Vol. 6, No. 8.

Although a variety of graphic representations are desired in Smalltalk or other systems, traditionally large amounts of memory have been required in order generate, store and manipulate graphics characters. In its simplest form, a block of memory may be allocated in a data processing storage system with each memory bit (a 1 or 0) mapped onto a corresponding picture element (pixel) on the display system. Thus, an entire CRT screen full of data, in the form of images and/or text, is represented as either a 1 (black dot) or a 0 (white dot) in a block of memory known as a "bitmap". However, the use of a one-to-one correspondance between the bitmap and the CRT display requires a significant amount of storage space within the computer's core memory. In addition, the generation and manipulation of an image or character requires that virtually all bits in the bitmap be updated after any modification to an image or the like. This procedure is both repetitive and time consuming, and significantly hampers the practical use of interactive graphics display operating systems.

One method of providing the necessary graphic capabilities, for systems such as Smalltalk, is "BitBlt" (Bit Boundry Block Transfer) as developed by the Xerox Learning Research Group, Palo Alto Research Center, Palo Alto, Calif. See, D. Ingalls, "The Smalltalk Graphics Kernal," *BYTE*, page 168, August 1981, Vol. 6 No. 8. BitBlt utilizes regions which are themselves small bitmaps and define simple forms, such as for example an arrow head shaped form to be used as a cursor, a pattern, etc. BitBlt, as will be discussed more fully below, transfers characters from a source bitmap; such as for example a font file of characters, to a destination bitmap (i.e. a block of memory to be displayed on a CRT) at given coordinates. By incorporating the use of a "clipping rectangle" which limits the region of the destination bitmap which can be effected, a portion of a larger scene can be mapped into a window such that only that portion of the transferred scene which falls within the window will be transferred. In addition, a variety of transfer operations are provided which control the combination of a transferred scene or character with an existing scene previously stored at the destination bitmap. However, the BitBlt system is limited in terms of the types of images which can be transferred and manipulated. Specifically, BitBlt is constrained to transfers of rectangular areas. This limitation significantly restricts its use as a graphics tool since BitBlt is thereby unable to transfer data to overlapping windows or the like. In addition, large amounts of memory are required for the BitBlt system. Other limitations in prior art systems, such as BitBlt, are described in this Patent in order to more fully identify the nature of the present invention.

As will be disclosed below, the present invention provides a means whereby any arbitrarily shaped region may be defined and stored using significantly less memory than was previously possible in the prior art. Additionally, the present invention provides a means whereby operations may be performed on regions efficiently and quickly by a digital computer.

SUMMARY OF THE INVENTION

The present invention provides methods and apparatus which are most advantageously used in conjunction with a digital computer to provide improved graphics capability. These techniques permit the representation and manipulation of any arbitrarily defined region in terms of "Inversion Points". An inversion point is by definition a point at which the state of all points having coordinates to the right and below the subject point are inverted (e.g. binary zeros are converted to binary ones and visa versa). A "Region" is defined as any arbitrary area which may include a number of groups of disjoint areas. Thus, any shape, such as for example an "L" shape is treated simply as another region to be defined and operated on. By defining a set of inversion points for any given region, all of the points which constitute the region need not be stored in memory, rather, only the inversion points defining the region need be stored.

Briefly stated, in accordance with one typical embodiment of the present invention, there is provided means for generating an input representation of a region, which may comprise any arbitrary shape or area the perimeter of which need not be a continuous curve and may include disjoint areas. This input representation is most advantageously coupled to a digital computer. Once received, the digital computer determines the position of the inversion points needed to define the region and sorts the points left to right and top to bottom in accordance with their coordinates in the region. Algorithm means are provided to transfer and operate on regions (or portions thereof) within the computer memory and to display a resulting region on an appropriate device, such as for example a cathode ray tube (CRT) or the like.

A scan line mask comprises a one scan line buffer, which in binary form represents existing regions which are currently being displayed and stored in a destination bitmap. The destination bitmap comprises a block of memory in which each bit corresponds to a pixel or the like on the display device. The scan line mask vertically scans down and "slices" the existing regions into horizontal rows corresponding to each raster line on the CRT display. Similarly, data from a source bitmap or font file, in the form of characters or the like, to be added to a portion of the destination bitmap is also "sliced" and placed into a horizontal scan line buffer corresponding to each raster scan line of the CRT. As one horizontal scan line is transfered from the source bitmap or the like to the destination bitmap, the contents of the source scan line buffer are compared to the contents of the scan line mask, such that the source scan line is "masked" and only selected portions of the source buffer are transferred to the destination bitmap. By using a variety of region operators, precedence between existing and new regions may be specified. Thus, a pattern (such as for example striped, checked or the like) may be added to an existing region, text may be overlayed, scrolling of text within a region may be easily accomplished, and numerous other graphics operations may be completed.

The resulting destination bitmap is converted to signals which are then applied to a CRT or other display device, and the image is displayed in a conventional manner.

NOTATION AND NOMENCLATURE

Figure 1:
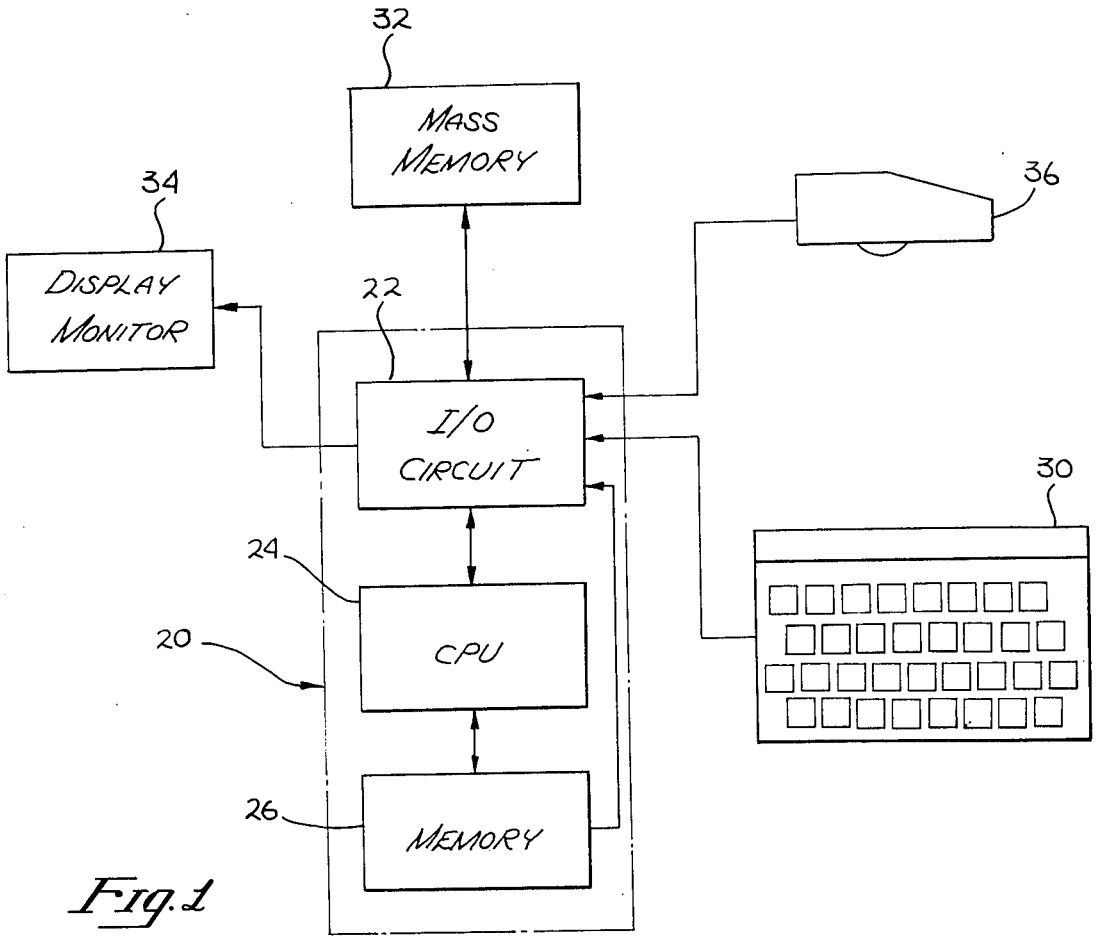
FIG. 1 illustrates a computer incorporating the present invention.

The detailed descriptions which follow are presented largely in terms of algorithms and symbolic representations of operations on data bits within a computer memory. These algorithmic descriptions and representations are the means used by those skilled in the data processing arts to most effectively convey the substance of their work to others skilled in the art.

An algorithm is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operations of the present invention include general purpose digital computers or other similar devices. In all cases there should be borne in mind the distinction between the method operations in operating a computer and the method of computation itself. The present invention relates to method steps for operating a computer in processing electrical or other (e.g., mechanical, chemical) physical signals to generate other desired physical signals.

The present invention also relates to apparatus for performing these operations. This apparatus may be specially constructed for the required purposes or it may comprise a general purpose computer as selectively activated or reconfigured by a computer program stored in the computer. The algorithms presented herein are not inherently related to any particular computer or other apparatus. In particular, various general purpose machines may be used with programs written in accordance with the teachings herein, or it may prove more convenient to construct more specialized apparatus to perform the required method steps. The required structure for a variety of these machines will appear from the description given below.

DETAILED DESCRIPTION

The following detailed description will be divided into several sections. The first of these will treat a general system arrangement for generating computer graphics. Subsequent sections will deal with such aspects of the present invention as defining an inputted region in terms of inversion points, the sorting of inversion points, operations on inversion points, generation of a scan line mask, and region transfer operations among others.

In addition, in the following description, numerous specific details are set forth such as algorithmic conventions, specific numbers of bits, etc., in order to provide a thorough understanding of the present invention. However, it will be obvious to one skilled in the art that the present invention may be practiced without these specific details. In other instances, well-known circuits and structures are not described in detail in order not to obscure the present invention unnecessarily.

GENERAL SYSTEM CONFIGURATION

FIG. 1 shows a typical computer-based system for generating computer graphic images according to the present invention. Shown there is a computer 20 which comprises three major components. The first of these is the input/output (I/O) circuit 22 which is used to communicate information in appropriately structured form to and from the other parts of computer 20. Also shown as part of computer 20 is the central processing unit (CPU) 24 and memory 26. These latter two elements are those typically found in most general purpose computers and almost all special purpose computers. In fact, the several elements contained within computer 20 are intended to be representative of this broad category of data processors. Particular examples of suitable data processors to fill the role of computer 20 included machines manufactured by the Apple Computer Co., Cupertino, Calif. Other computers having like capabilities may be of course be adapted in a straightforward manner to perform the several functions described below.

Also shown in FIG. 1 is an input device 30, shown in typical embodiment as a keyboard. It should be understood, however, that the input device may actually be a card reader, magnetic or paper tape reader, or other well-known input device (including, of course, another computer). A mass memory device 32 is coupled to the I/O circuit 22 and provides additional storage capability for the computer 20. The mass memory may include other programs, fonts for given characters, and the like and may take the form of a magnetic or paper tape reader or other well known device. It will be appreciated that the data retained within mass memory 32, may, in appropriate cases, be incorporated in standard fashion into computer 20 as part of memory 26.

In addition, a display monitor 34 is illustrated which is used to display the images being generated by the present invention. Such a display monitor may take the form of any of several well-known varities of CRT displays. A cursor control 36 is used to select command modes and edit graphics data, such as for example a particular image, and provides a more convenient means to input information into the system.

Figure 2:
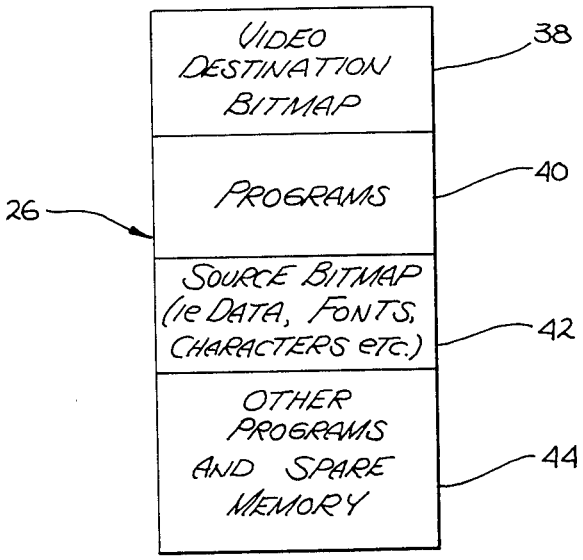
FIG. 2 shows a typical arrangement of program storage in the system of FIG. 1.

FIG. 2 shows a typical arrangement of the major programs contained within the memory 26 illustrated in FIG. 1. In particular, there is shown a video destination bitmap 38, which in the presently preferred embodiment comprises approximately 32 kilobytes of storage. This destination bitmap represents the video memory for the display monitor 34. Each bit in the destination bitmap corresponds to the upper left coordinate of a corresponding pixel on the display monitor. Thus, the destination bitmap can be described by a two-dimensional array of points having known coordinates. Of course, in the case where other display means are used, such as for example a printer or the like, the contents of the bitmap 38 would represent the data points to be displayed by the particular display device. Memory 26 also includes programs 40 which represent a variety of sequences of instructions for execution by the CPU. For example, the control program implimenting the operations and routines described in this Patent, monitor and control programs, disk operating systems and the like may be stored within this memory location.

Source bitmap 42 which may comprise regions, fonts, data structures, coordinates and characters are also stored in memory 26, or may be temporarily stored in mass memory unit 32 as may be required in any given application of the present invention. Additionally, space within memory 26 is reserved for other programs and spare memory which is designated at 44. These other programs may include a variety of useful computational or utility programs as may be desired.

INVERSION POINT REPRESENTATION OF DEFINED REGIONS

Figure 3:
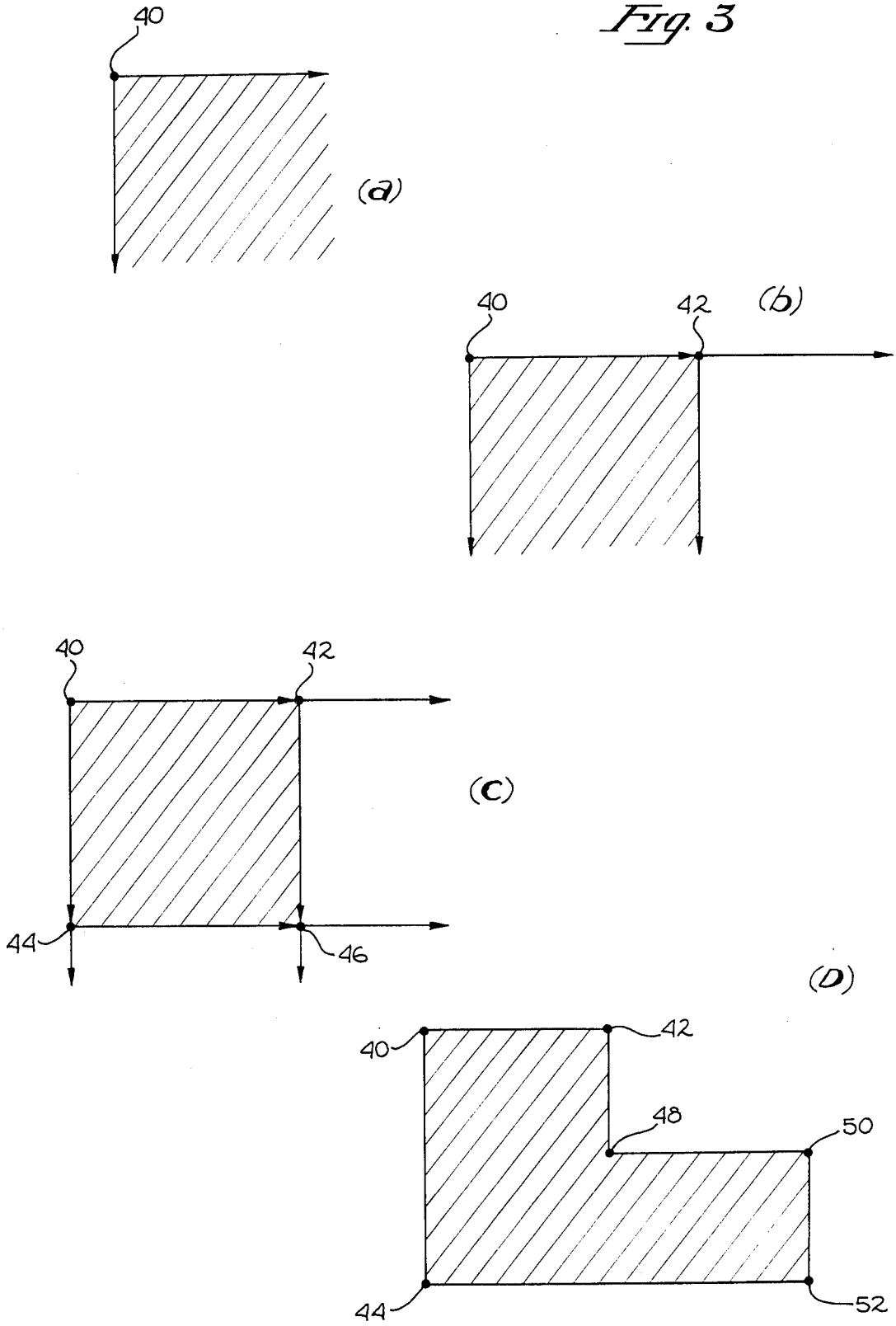
FIGS. 3(*a*)–(*h*) illustrate the use of inversion points to define a region.
Figure 3:
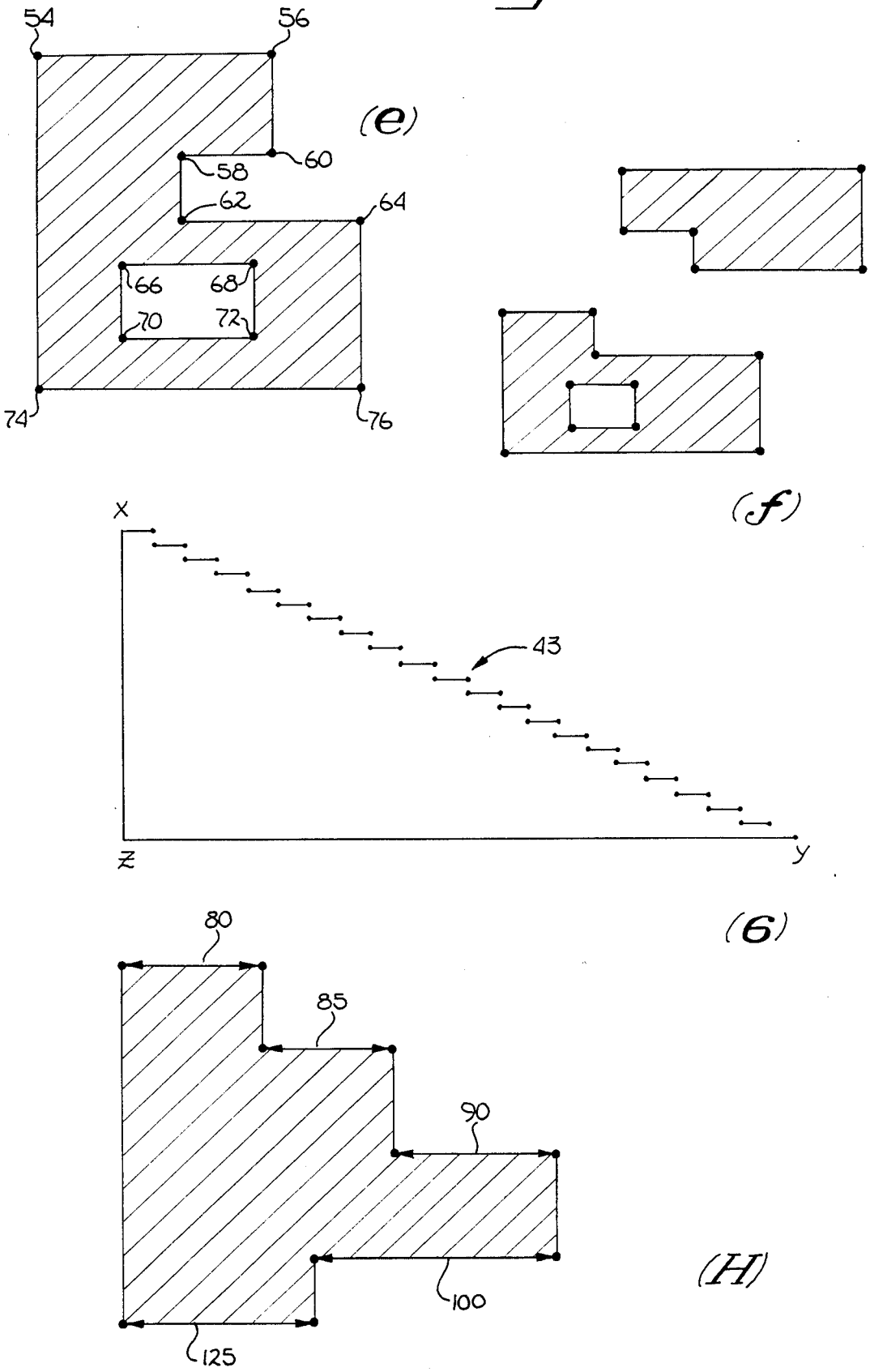

The present invention represents any arbitrarily defined region in terms of "inversion points". In addition, the present invention defines a "region" to be any arbitrary area which may include a plurality of disjoint areas of any shape or configuration. Referring now to FIG. 3(*a*), an inversion point 40 is illustrated. An inversion point is, by definition, a point at which the state of all points having coordinates to the right and below the inversion point are inverted. Thus, as depicted, all areas to the right and below the point 40 are dark since point 40 was defined on a previously white background. In terms of the physical implementation of the inversion point system, the position of an inversion point is described in terms of its coordinates in a memory bitmap.

As illustrated in FIG. 3(*b*), a vertical unbounded strip results when two inversion points, 40 and 42, are defined on a bitmap such as destination bitmap 38, and subsequently displayed on monitor 34. The addition of the point 42 on the bitmap inverts the state of all points having coordinates to its right and below it, cancelling the effect of point 40 within this area and thereby defining a darkened vertical strip.

Similarly, four inversion points 40, 42, 44 and 46 define a square or other quadrangle as shown in FIG. 3(*c*). As illustrated in FIGS. 3(*d*) and (*e*) other areas may be defined using inversion points, and voids within a given shape may be easily generated. In addition, it will be apparent that any given region may contain any number of disjoint areas, as shown in FIG. 3(*f*), inasmuch as all shapes within a region are simply defined by the coordinates of the inversion points.

Moreover, circular and other non-linear regions may be defined by proper positioning of inversion points. With reference to FIG. 3(*g*), a diagonal line 43 may be defined between points "X" and "Y" by a step series of two inversion points between "X" and "Y." Although a direct diagonal line between points would be preferred, the physical structure of the raster line display monitor 34 does not permit this. Each pixel on the CRT display occupies a unit area between given coordinates, where by convention a particular pixel is accessed by the coordinate of the grid point which lies at its top left. Thus, a step-like function of inversion points defining a series of horizontal line segments is required to approximate a diagonal line.

It will be appreciated that once any given region is defined in terms of its inversion points, in general only the inversion points need be retained in memory 26, unlike many prior art systems which require that virtually all points comprising an image be stored. In the presently preferred embodiment, a region is entered into the computer 20 by a user by means of cursor control 36 or other input device. The position of the inversion points defining the region is determined by detecting horizontal line segments which in part form portions of the imputted region. With reference to FIG. 3(*h*), line segments 80, 85, 90, 100 and 125 are thus identified. Inversion points are then defined at the coordinates corresponding to the end points of each line segment, thereby defining the entire region in terms of its inversion points. Vertical line segments within the region are ignored since they will be generated automatically, by definition, using the previously described inversion point convention. The specific sequence of operations which are required to be executed by computer 20 to detect and isolate horizontal line segments, will be apparent to those skilled in the data processing arts, and will not be set forth in this description. The inversion points of a region are sorted into an ordered list of points in a left to right, top to bottom order in accordance with their coordinates. For example, with reference to the region of FIG. 3(*e*) the list of inversion points in accordance with the convention would be as follows: 54, 56, 58, 60, 62, 64, 66, 68, 70, 72, 74, 76.

Figure 4:
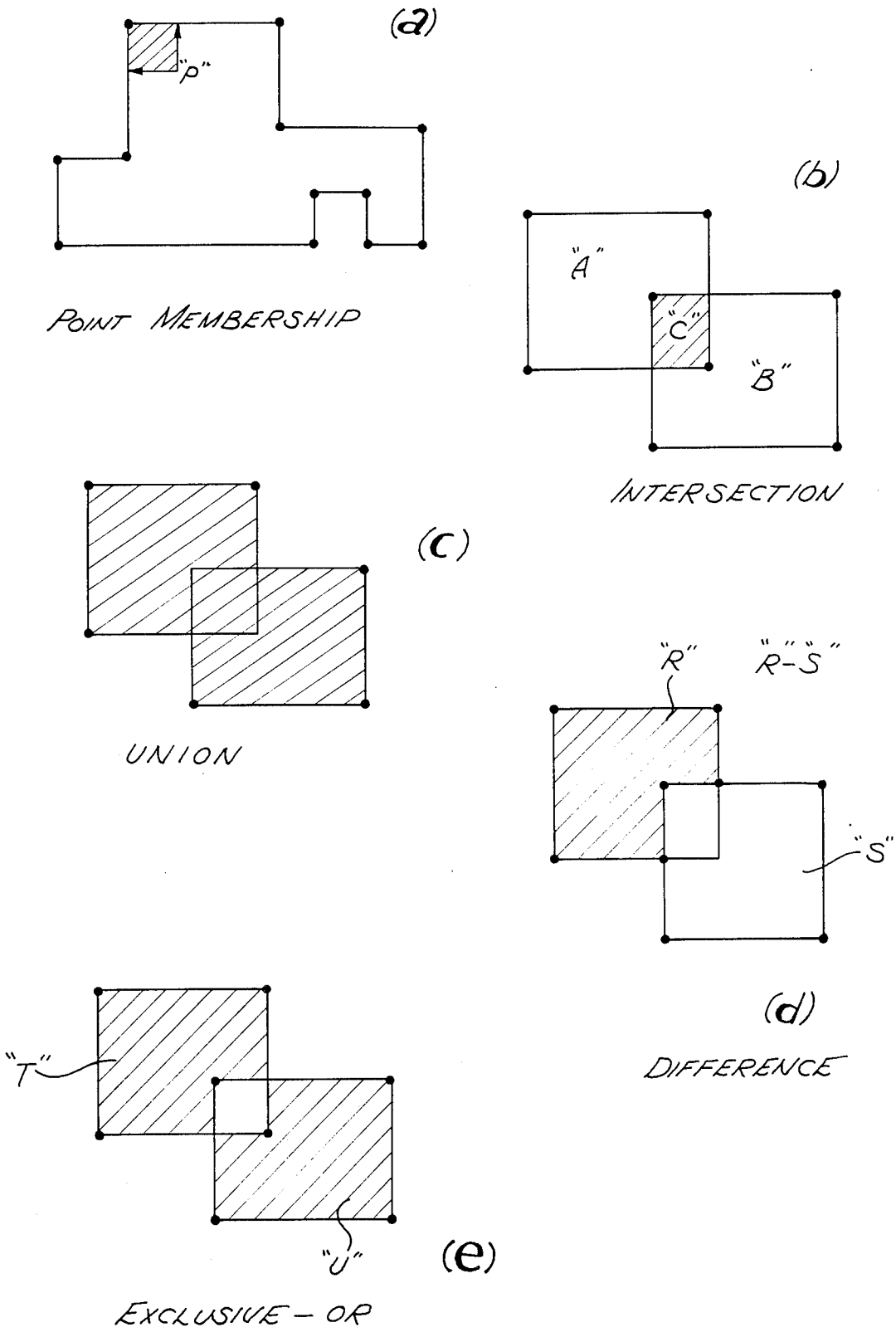
FIGS. 4(*a*)–(*e*) illustrate operations on regions using inversion points which may be accomplished using the present invention.

It has been found, that the use of the above convention permits simplified operations on regions such as those illustrated in FIGS. 4(*a*)–(*e*). Typical operations which may be performed using the present invention's use of ordered lists of inversion points are the functions of the determination of point membership, as well as the intersection, union, differerence, and exclusive-OR of regions.

Frequently, in the course of a graphics operation, it is necessary to determine if a point in the destination bitmap 38 (and thereby correspondingly displayed on the display monitor) lies within a particular region. This function is generally referred to as "point membership". Traditionally, the determination of point membership required rather extensive data manipulations and calculations. For example, one prior art method of determining point membership was to calculate and sum the angles from the point in question to the region of interest. If the sum of the angles equals 360 degrees then point membership within the region exists. It will be appreciated that this particular method of determining point membership requires numerous and repetitive calculations and is extremely time consuming.

However, the present invention's use of inversion points provides an efficient means to determine point membership. With reference to FIG. 4(*a*), the present invention scans through the previously ordered list of inversion points defining the region in question, from top to bottom. If an inversion point has a vertical coordinate greater then or equal to the vertical coordinate of the point in question (point "P" in FIG. 4(*a*)), and the inversion point's horizontal coordinate is less than that of point "P", a variable is "toggled" which is either true or false (and which was originally set, for example, to false). Thus, each time and inversion point above and to the left of the point in question is detected, the state of a true/false variable is switched. If, after scanning through the list of inversion points defining the region the variable is true (i.e. an odd number of state changes occurred) the point in question (i.e. point "P") lies within the particular region. However, if the variable is false (i.e. zero or an even number of state changes occurred) the point is not within the region. Thus, a quick and efficient method for determining point membership using inversion points is provided by the present invention which was not possible in the prior art.

REGION TO SCAN LINE BUFFER TRANSFORMATION

Figure 5:
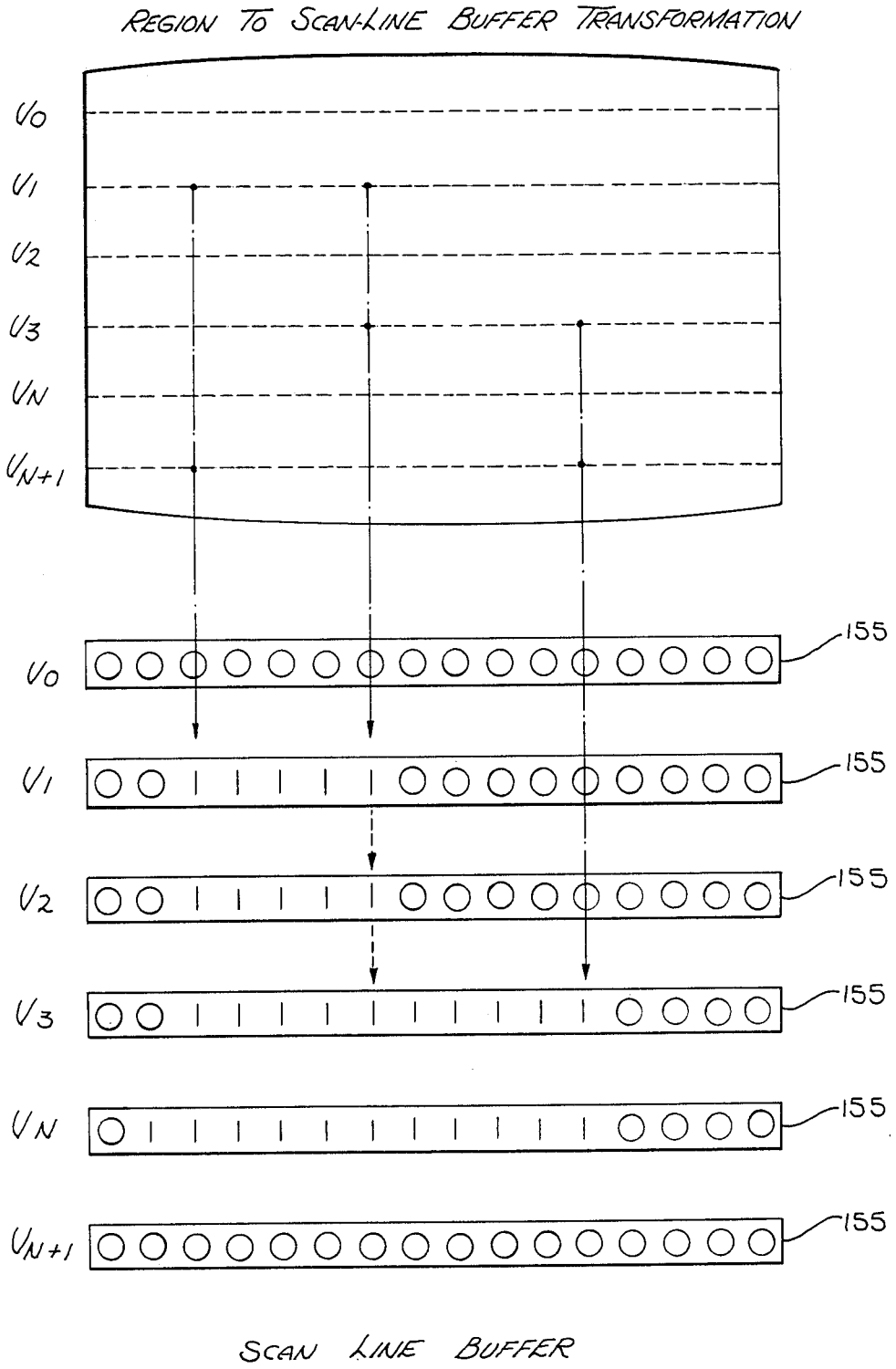
FIG. 5 illustrates the process of converting a region defined by inversion points into a one scan line buffer scanning vertically down a region.

The present invention's use of ordered lists of inversion points provides a straightforward means of representing the contents of each raster scan line on monitor 34. Referring now to FIG. 5, portion of memory 40 (See FIG. 2) is allocated as a one scan line buffer. In the presently preferred embodiment, this can line buffer is sufficiently large such that each horizontal row of pixels on the CRT monitor screen or other output device is represented by a bit within the buffer. A region which has been previously defined in terms of an ordered list of inversion points may be represented by bit states within the scan line buffer. For every horizontal row displayed on monitor 34, designated $V_o$, $V_1$, $V_2$ . . . $V_{n+1}$ in FIG. 5, inversion points having vertical coordinates corresponding to the particular horizontal row which is scanned are represented by an altered bit state (i.e. a 1 in an original scan line field of 0's) at appropriate coordinates on the scan line buffer. All bits between pairs of inversion points in scan line 155 are then inverted, such that a true representation of the region to be displayed is generated from the inversion point ordered list. Thus, as shown in FIG. 5, by scanning through each horizontal row to be displayed, any region may be horizontally and sequentially "sliced" into segments one scan line wide.

As will be discussed below, the use of a single raster scan line buffer allows a region to be transferred from a source bitmap 42 to the destination bitmap 38 and appropriately "masked" such that any arbitrary region may be transferred and manipulated, unlike prior art systems such as BitBlt which are confined to rectangular region transfers.

In addition, it will be appreciated that the region to scan line buffer transform is reversable. Once a region is represented in the form of a one scan line buffer, an ordered set of inversion points may be redefined by locating inversion states on the buffer as the buffer scans a region from its top ($V_1$) to bottom ($V_{n+1}$). Inversion point positions are located easily inasmuch as an inversion point position on the buffer is that point where a bit state change is sensed (i.e. a 1 where the next bit is a 0). More specifically, in the present embodiment the location of inversion points may simply be determined by an exclusive-OR operation between the current scan line (e.g., $V_3$) buffer contents and the previous (e.g., $V_2$) scan line buffer contents. Thus, the portions of regions which remain unchanged between subsequent vertical scan line positions are ignored inasmuch as a uniformity of content between one vertical scan line position and the next would indicate that no inversion points are present. In addition, horizontal positions of inversion points may then be determined by shifting the resulting exclusive-OR ed scan line to the right by 1 bit, and effectuating another exclusive-OR operation. For example, if after the exclusive-OR operation between scan line buffer $V_n$ and $V_{n-1}$ the result was 01110011, then by shifting the result to the right one bit and completing another exclusive-OR operation we obtain:

$$\begin{array}{l} 01110011 \\ \underline{00111001(1)} \\ 01001010 \text{ - inversion point positions for scan line } V_n \end{array}.$$

The specific commands to be executed by computer 20 in order to determine where in a scan line buffer a state change exists will be apparent to one skilled in the art, and will not be further described.

REGION OPERATORS

Figure 6:
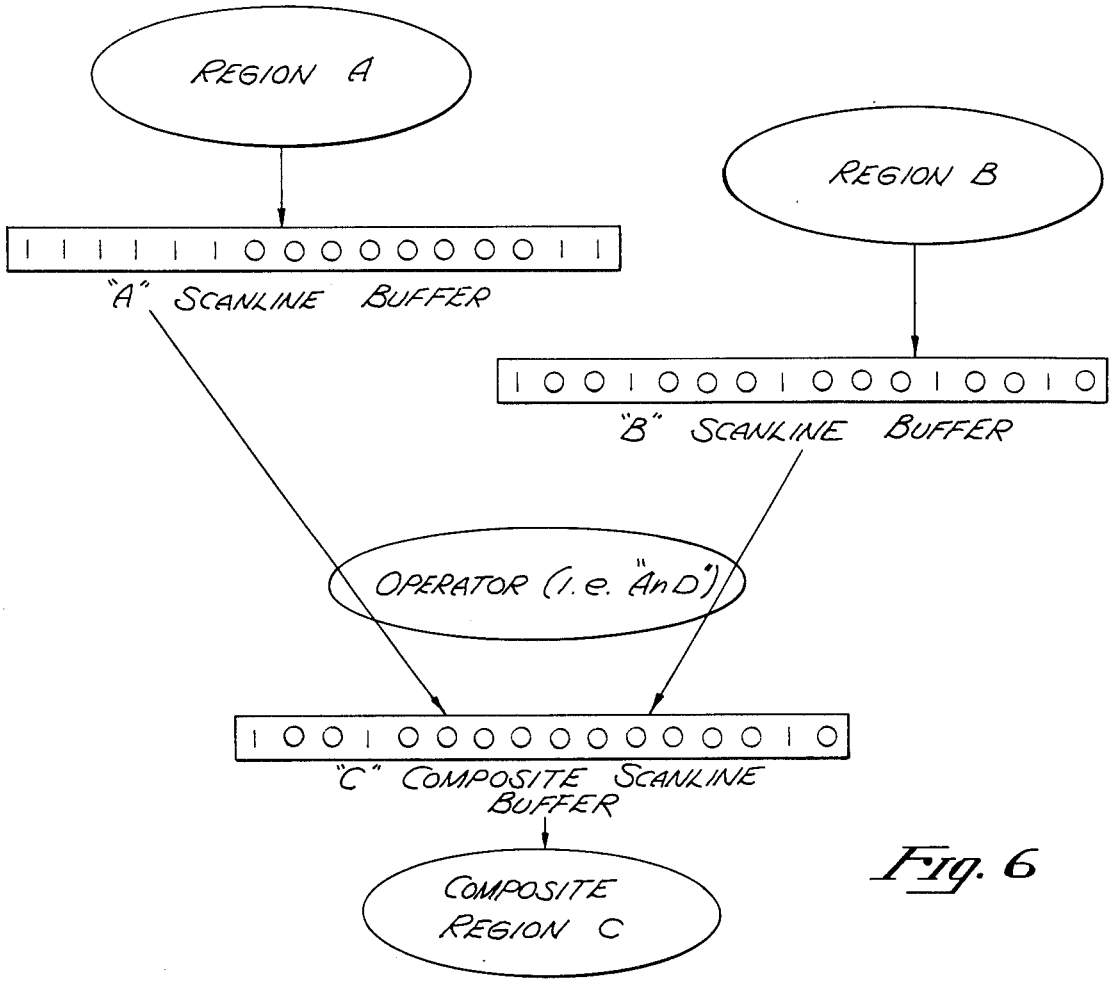
FIG. 6 symbolically illustrates the "AND" operation between two regions one scan line at a time.

The present invention's use of a one scan line buffer to systematically represent the contents of regions permits the previously described operations of union, intersection, etc., to be easily accomplished. For example, the intersection operation illustrated in FIG. 4(*b*) provides an inversion point representation of the shaded area, and is obtained by executing an "AND" of the two overlapping regions "A" and "B." Referring now to FIG. 6, a one scan line buffer is defined for each region "A" and "B." For each horizontal raster row of the CRT display, the respective scan line buffer represents each region's contents in binary form. The contents of the scan line buffers are then operated upon in order to accomplish the desired function. In the case of FIG. 4(*b*), the contents would be "AND"ed together to result in a composite scan line. For example, if for vertical position $V_1$:

"A" scan line=11111100

"B" scan line=10010001

Then the composite scan line after an "AND" operation would be: 10010000. In addition, the identical "AND" operation is done for each horizontal row $V_n$ comprising each region. The result of the above operation being a composite representation, one scan line at a time, of the resulting intersecting shaded region "C" of FIG. 4(*b*). The position of the inversion points comprising the shaded region "C" may then be extracted using known techniques, such as the exclusive-OR operation previously described.

Similarly, an "OR" operation between the two regions is utilized in order to achieve the union function of FIG. 4(*c*). To obtain the "Difference" of FIG. 4(*d*), the operation between the two regions would be (NOT "S") AND "R", wherein the state of all binary quantities represented within the "S" scan line buffer is inverted prior to "AND"ing the contents with the "R" scan line buffer.

Finally, the exclusive-OR operation of FIG. 4(*e*) is simply achieved by performing the exclusive-OR on each region's scan line buffer contents, in the same manner as was done in the above example of the "AND" operation. However, it will be apparent to one skilled in the art that the present invention's use of ordered lists of inversion points renders the exclusive-OR operation trivial. The operation may be accomplished by merge sorting the inversion point lists of regions "T" and "U" of FIG. 4(*e*), and discarding any points having the same coordinates in both regions. In other words, computer 20 simply treats the ordered lists of inversion points defining regions "T" and "U" as one large list, and sorts all of the inversion points, left to right and top to bottom in accordance with the previously described convention. The resultant list of inversion points represents a region whose points are contained either in region "T" or "U" but not both.

It will be appreciated that numerous other operations, and combinations of operations, using the present invention's inversion point and scan line buffer method may be performed on arbitrary regions that was possible in prior art methods.

SCAN LINE MASK

Figure 7:
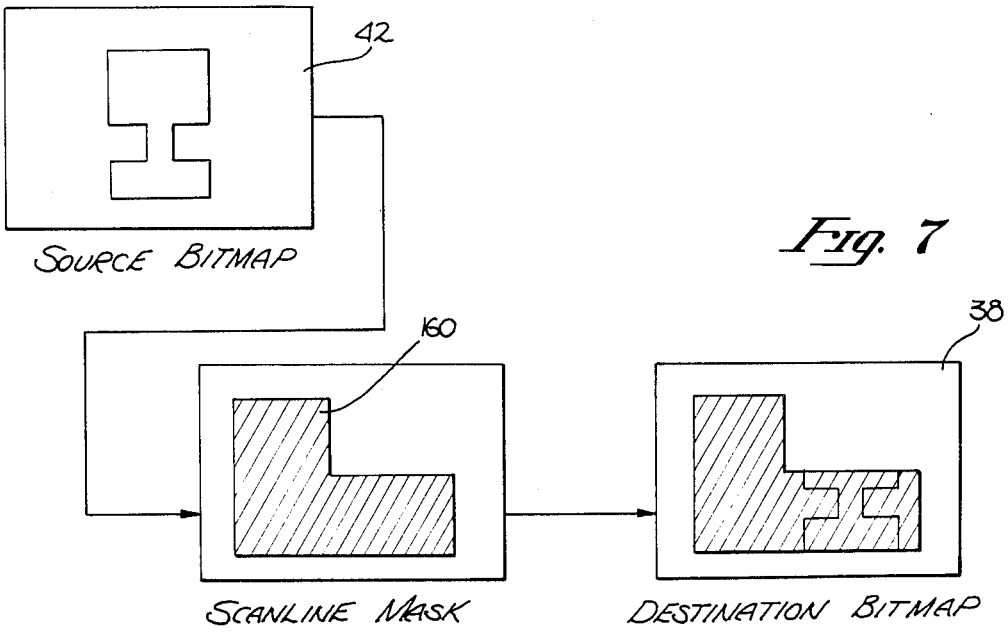
FIG. 7 symbolically illustrates the operation of a bitmap mask to selectively mask portions of a source region to be displayed.
Figure 9:
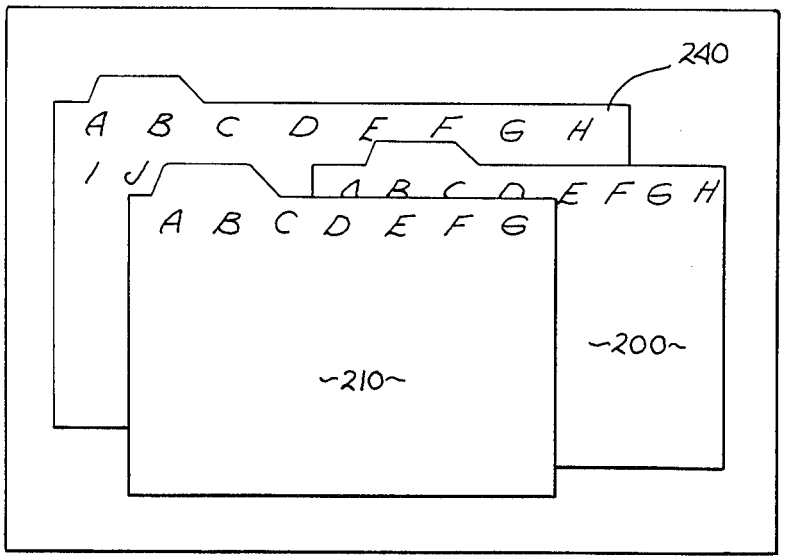
FIG. 9 illustrates the result of one implimentation of the present invention using the inversion point scan line mask system.

With reference now to FIG. 7, the present invention's use of a scan line mask to provide arbitrary region clipping is symbolically illustrated. A previously defined region 160 which has been converted into an ordered list of inversion points is used as a "mask" to which all additional images to be displayed on the monitor 34 are compared, prior to affecting the destination bitmap 38. As shown in FIG. 9, it is frequently desired that multiple regions overlap with some predetermined precedence. As is illustrated, folders may be depicted as overlapping, text may be provided on each displayed folder, and other arbitrary regions may be displayed. However, as discussed above, prior art methods such as BitBlt are constrained to rectangular "region clipping". Thus, the versatility of prior art systems is severely limited by the constraint of operating on rectangular regions only, and their inability to selectively affect regions other than the topmost window (e.g. folder 210).

As symbolically illustrated in FIG. 7, other regions such as patterns or characters are compared to a bitmap "mask", one scan line at a time, of existing regions which are currently being displayed. As will be discussed below, by defining region operators various masking priorities may be defined. Thus, patterns may be provided as well as fonts and other characters within any arbitrary region. "Region clipping" is provided in accordance with the region operators such that portions of overlapping regions are selectively displayed.

Figure 8:
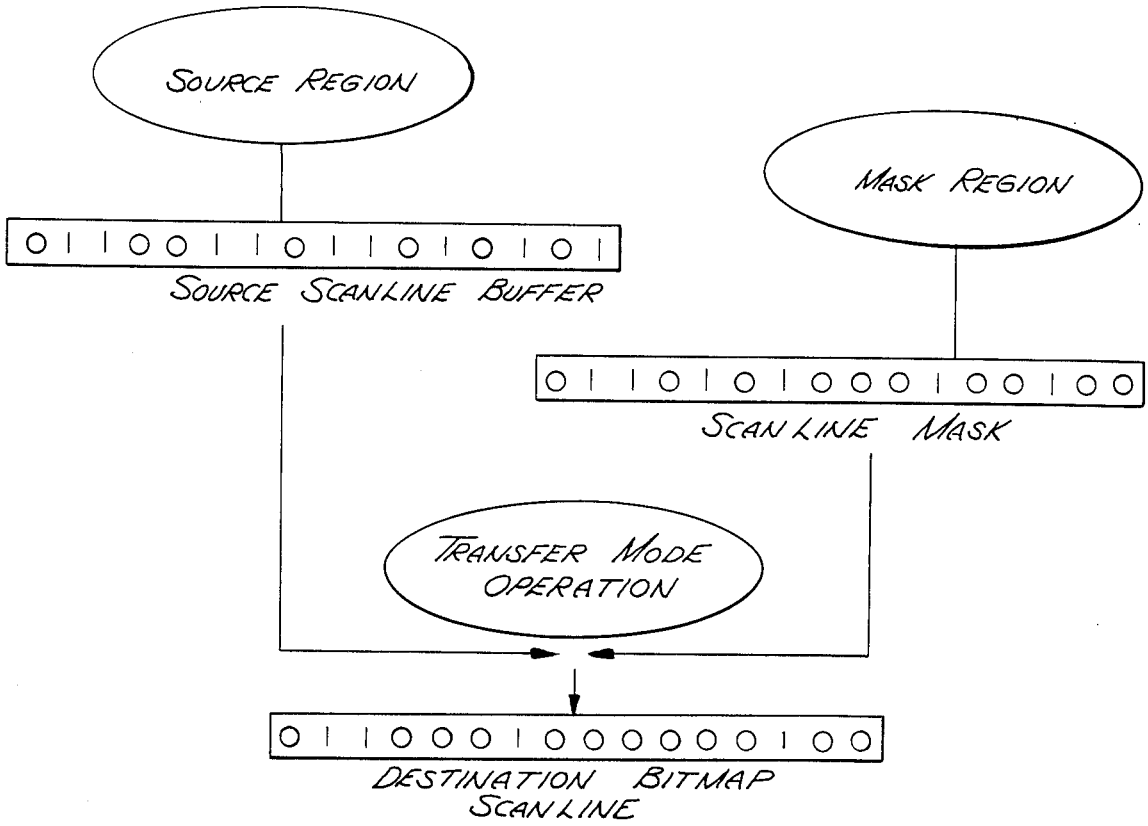
FIG. 8 symbolically illustrates the use of one scan line buffer and a scan line mask to selectively mask portions of a source region prior to its transfer to the destination bitmap for display.

Referring now to FIG. 8, each source bitmap 42 which may comprise an image, character, font or the like which is desired to be displayed is "sliced" and transformed into a one scan line buffer in accordance, with for example, the above discussion under the heading "Region to Scan line Buffer Transformation." Thus, any region to be displayed is represented by a one line scan buffer which horizontally scans the source bitmap 42 and provides a binary representation of the source region by proper expansion of inversion point positions along the buffer.

The regions which are presently being displayed form a bitmap "mask" region to which new regions to be displayed are compared. As is done with the new source regions to be added, the existing displayed regoin is transformed into a one scan line mask representing the contents in binary form of the destination region. Depending on the transfer mode operation specified, each scan line of the new region is selectively transferred to the destination bitmap 38 and displayed on the display monitor 24.

The specific type of transfer mode operator used is a function of the desired output. Region operators include the functions of OR, AND, exclusive-OR, NOT as well as any combination thereof. For example, if the current scan line mask for row $V_1$ on the CRT contains 01101010 and the current source scan line buffer for $V_1$, contains 01100110 then the result after an "AND" operation which would be displayed on monitor 34 would be:

01101010 - scan line mask buffer contents
(AND) 01100010 - source scan line buffer contents
01100010 - destination bitmap scan line contents to be displayed Thus, it will be appreciated that not all portions of the new source region will be transferred to the display device, and is thereby "clipped" depending on the particular transfer operator chosen. In addition, it will be noted that the particular shape of the regions being operated upon is irrelevant to the method of the present invention. The use of inversion points and one scan line buffers allow any arbitrary region to be defined, masked and transferred by the present invention.

In the presently preferred embodiment, three separate scan line mask buffers are provided to which a new source region is compared. A "user region" mask comprises the existing region being displayed which the new region, if transferred, will affect. A "visible region" mask is defined as the visible portion of the existing region currently being displayed (e.g., folder 200 of FIG. 9). The "clipping region" comprises the visible portion of the user region to which the new source region will be "clipped", such that only a portion of the source region is transferred. Thus, a new source region to be transferred from the source bitmap 42 to the destination bitmap 38 is passed through the equivelent of three scan line mask buffers. In practice, each scan line mask is "AND" ed with one another and the composite scan line mask is then utilized to mask new regions.

With reference to FIG. 9, an example of an output displayed on monitor 34 in accordance with the present invention is illustrated. Region 200 was originally defined by a user and stored in memory 26 as an ordered list of inversion points. By specifying a proper region operator as described above, regions 210 and 240 have been displayed such that it appears that region 200 lies between regions 210 and 240. Similarly, text has been provided within each folder shaped region, and appropriate region clipping using the scan line mask method as described above insures that only those portions of each region which would be visible if actual folders were used is displayed.

Moreover, it will be apparent to one skilled in the art that although the present invention has been described with emphasis on binary representations on the display device 34, and therefore in black and white, that appropriate inversion point and scan line masking for color images may also be achieved. For example, to provide the colors of red, green and blue, three inversion point representations of a region may be utilized, one for each color respectively. Thus, the presence of an inversion point in one color region may selectively discharge a color gun in a color CRT or the like for that color. Similarly, various colors could be acheived by the appropriate combination of the three inversion point representations of each region stored in memory.

CODING DETAILS

No particular programming language has been indicated for carrying out the various procedures described above. This is in part due to the fact that not all languages that might be mentioned are universally available. Each user of a particular computer will be aware of the language which is most suitable for his immediate purposes. In practice, it has proven useful to substantially implement the present invention in an Assembly language which provides a machine executable object code.

Because the computers and the monitor systems which may be used in practicing the instant invention consist of many diverse elements, no detailed program listings have been provided. It is considered that the operations and other procedures described above and illustrated in the accompanying drawings are sufficiently disclosed to permit one of ordinary skill to practice the instant invention or so much of it as is of use to him.

Thus, methods and apparatus which are most advantageously used in conjunction with a digital computer to provide improved graphics capability have been disclosed. The present invention's use of inversion points and scan line masking allows any arbitrary region to be defined, manipulated and transferred faster and more efficiently than systems previously found in the art.

While the present invention has been particularly described with reference to FIGS. 1–9 and with emphasis on certain computer systems, it should be understood that the figures are for illustration only and should not be taken as limitations upon the invention. In addition, it is clear that the methods and apparatus of the present inventions has utility in any application where graphic representations on a CRT or other display device are desired. It is contemplated that many changes and modifications may be made, by one of ordinary skill in the art, without departing from the spirit and scope of the invention as disclosed above.

I claim:

1. A computer display system, comprising:

display means for providing a display including a plurality of display elements, each of said display elements being selectively enabled;

memory means for storing a plurality of inversion points, each of said inversion points having a coordinate corresponding to an element on said display, wherein the coordinates of each inversion point specify orthogonal lines extending in the direction of subsequently enabled display elements from said inversion point and forming two boundaries of a contrasting area;

processing means coupled to said memory means for enabling elements on said display which correspond to said stored inversion points, and generating said contrasting areas on said display, the contrast of an area being a function of the coordinates of previously displayed inversion points;

whereby a region which comprises a plurality of inversion points may be displayed by enabling said corresponding elements and generating said associated contrasting areas on said display means.

2. The display system of claim 1 wherein said display means includes a plurality of raster scan lines comprising said elements defining said display.

3. The display system of claim 2 wherein said processing means includes reading means for reading said inversion points from said memory in the order in which said elements are scanned by said display means.

4. The display system of claim 3, wherein said processing means includes sorting means for sorting said inversion points into an ordered list in accordance with a predetermined convention and storing said list in said memory means.

5. The display system of claim 4 further including input means coupled to said processing means for inputting a region to be displayed into said memory.

6. The display system of claim 5 wherein said processing means further includes inversion point locating means for determining the coordinates of inversion points comprising said inputted region.

7. The display system of claim 6 wherein said processing means further includes logic means for executing logic operations between ordered lists of inversion points defining at least two regions.

8. The display system of claim 7 wherein said logic operations include the functions of logical AND, OR, NOT, and exclusive -OR.

9. The display system of claim 7 wherein said reading means reads a destination bitmap within said memory means, said destination bitmap including a plurality of inversion points representing regions currently being displayed on said raster scan display.

10. The display system of claim 9 wherein said memory means further includes at least one source bitmap, said source bitmap including a plurality of inversion points representing regions at least some portion of which may be transferred to said destination bitmap.

11. The display system of claim 10 wherein at least one scan line buffer is defined within said memory means, said scan line buffer being sufficiently large such that it contains adequate bits to represent all elements disposed along a scan line of said raster scan display.

12. The display system of claim 11 wherein said reading means sequentially reads inversion points in said source bitmap and provides a representation of said region in said scan line buffer thereby providing a scan of said region in said source bitmap corresponding to each scan line of said display means.

13. The display system of claim 12 wherein at least one scan line mask buffer is provided within said memory means, said scan line mask sequentially providing a scan of said destination bitmap such that the contents of said scan line mask are representative of a region stored within said destination bitmap in the order in which it is scanned by said display means.

14. The display system of claim 13 further including comparison means for comparing the contents of said scan line mask and said scan line buffer, such that prior to the transfer of the contents of said scan line buffer from said source bitmap to said destination bitmap for display, the contents of said scan line buffer are compared to the contents of said mask buffer for each scan line position of said display means.

15. The display system of claim 14 further including precedence control means for providing a predetermined priority as defined by a user between the contents of said scan line mask buffer and said scan line buffer as compared by said comparison means, and for transferring portions of said scan line buffer which have precedence to said destination bitmap for display.

16. The display system of claim 15 wherein each region inputted into said memory means is defined by at least two inversion points having the same coordinates in different bitmaps, each of said inversion points corresponding to a different color to be displayed on said display means.

17. A method for generating and manipulating graphic representations on a computer controlled display system, said display system including a plurality of display elements, each of said elements being selectively enabled, comprising the steps of;

providing memory means within said computer including storage for a plurality of inversion points, each of said inversion points having a coordinate corresponding to an element on said display system, wherein the coordinates of each inversion point specify orthogonal lines extending in the direction of subsequently enabled display elements from said inversion point and forming two boundaries of a contrasting area;

inputting a region comprising a plurality of inversion points into said memory means;

displaying said inversion points comprising said region by enabling said corrsponding elements on said display and generating said contrasting areas on said display, the contrast of a display being a function of the coordinates of previously displayed points;

whereby said region is displayed by displaying said inversion points comprising said region and generating said associated contrasting areas on said display.

18. The method as defined by claim 17 further including the step of identifying and storing in said memory means the inversion points defining said region.

19. The method as defined by claim 18 wherein said display system includes a plurality of raster scan lines comprising said elements of said display.

20. The method as defined by claim 19 further including the step of reading said inversion points defining said region from said memory in the order in which said elements are scanned by said display system.

21. The method as defined by claim 20 wherein said storing step includes sorting said inversion points into an ordered list in accordance with a predetermined convention.

22. The method as defined by claim 21 wherein said sorting convention comprises sorting said inversion points in accordance with their coordinates, such that said points are sorted left to right and top to bottom relative to one another.

23. The method as defined by claim 22 further including the step of providing a one scan line buffer defined within said memory means, said reading means sequentially providing a representation of said region in said scan line buffer corresponding to each scan line on said display.

24. The method as defined by claim 23 further including the step of providing a one scan line mask buffer within said memory means, said mask buffer sequentially providing a representation of a region being displayed on said display such that the contents of said mask buffer correspond to each scan line of said display.

25. The method as defined by claim 24 further including the step of comparing the contents of said scan line buffer with the contents of said scan line mask.

26. The method as defined by claim 25 further including applying a predetermined priority between the contents of said scan line buffer and said scan line mask, such that only selected portions of said scan line buffer contents are displayed on said display system.

27. A method for selectively transferring data from a first location in a computer memory to a second location in said memory, comprising the steps of:

defining a one scan line buffer in said memory, said scan line buffer sequentially representing said data in said first location;

defining a one scan line mask buffer in said memory, said scan line mask sequentially representing data in said second location;

sequentially comparing the contents of said scan line buffer with the contents of said scan line mask prior to the transfer of the contents of said scan line buffer to said second location;

providing a predetermined precedence as defined by a user between the contents of said scan line buffer and said scan line mask, such that only selected data comprising said scan line buffer having priority is transferred to said second location;

whereby data is selectively transferred from said first location to said second location.

28. The method as defined by claim 27 wherein said second location comprises a plurality of bits, each bit corresponding to an element on a display system.

29. The method as defined by claim 28 wherein data in said second location is displayed on said display system.

30. The method as defined by claim 29 wherein said scan line buffer sequentially represents said data in said first location in the order in which said data will be displayed on said display system.

31. The method as defined by claim 30 wherein said scan line mask sequentially represents data in said second location in the order in which said data is displayed.

32. The method as defined by claim 31 wherein said data within each of said locations is representative of at least one region, said region comprising a plurality of inversion points each of said points having a coordinate corresponding to an element on said display, wherein coordinates of each inversion point specify orthagonal lines extending in the direction of subsequently enabled display elements from said inversion point and forming two boundaries of a contrasting area.

33. The method as defined by claim 32 wherein the process of determining the location of inversion points defining said region includes the steps of:

detecting horizontal line segments comprising said region;

defining inversion points at coordinates corresponding to the end points of said line segments.

34. The method as defined by claim 33 further including the step of sorting said inversion points defining said region in accordance with a predetermined convention.

35. The method as defined by claim 34 further including a process to determine if a specified point lies within said region, said region being defined by an ordered list inversion points arranged such that said inversion points are sorted in accordance with their coordinates left to right and top to bottom relative to one another, comprising the steps of:

defining at least one flag bit in said memory, said flag bit initially set in a first state;

scanning through said ordered list and switching said flag bit to a second state in a event that an inversion point in said list has a vertical coordinate greater than or equal to the vertical coordinate of said specified point and a horizontal coordiate less than that of said specified point;

determining the state of said flag bit.

* * * * *